US005653393A

United States Patent [19]

Tanaka et al.

[11] Patent Number: 5,653,393

[45] Date of Patent: Aug. 5, 1997

[54] CONE CRUSHER

[75] Inventors: Takeshi Tanaka; Shoji Inomata, both of Takasago, Japan

[73] Assignee: Kabushiki Kaisha Kobe Seiko Sho, Kobe, Japan

[21] Appl. No.: 551,804

[22] Filed: Nov. 7, 1995

[30] Foreign Application Priority Data

Nov. 7, 1994 [JP] Japan ..... 6-272342

[51] Int. Cl.[6] ..... B02C 25/00

[52] U.S. Cl. ..... 241/37; 241/101.3; 241/207; 241/286

[58] Field of Search ..... 241/207–216, 241/37, 101.3, 286

[56] References Cited

U.S. PATENT DOCUMENTS

| | | | |
|---|---|---|---|
| 3,737,109 | 6/1973 | Johansson | 241/37 |
| 4,856,716 | 8/1989 | Burstedt | 241/37 X |

FOREIGN PATENT DOCUMENTS

| | | | |
|---|---|---|---|
| 6-39133 | 5/1994 | Japan . | |
| 6-154630 | 6/1994 | Japan . | |
| 1595567 | 9/1990 | U.S.S.R. | 241/37 |
| 1599095 | 10/1990 | U.S.S.R. | 241/37 |

OTHER PUBLICATIONS

Database WPI, Derwent Publications, AN 62471B/29, SU–A–625 770, Sep. 5, 1978.

*Primary Examiner*—Mark Rosenbaum

*Attorney, Agent, or Firm*—Oblon, Spivak, McClelland, Maier & Neustadt, P.C.

[57] ABSTRACT

The structure of this invention involves a driving device for rotating a concave support, an input detection device for detecting a variation of electric current to a driving motor of the driving device, a rotation detection device for detecting the number of revolutions of the concave support, an operation display device for processing a signal from the rotation detection device on the basis of a conversion program to operate a moving amount of the concave support to store and display it, and a backpressure detection device for detecting a variation of backpressure of a static pressure type thrust bearing of a main shaft, the input detection device, the operation display device and the backpressure detection device are connected to a control device of the driving device.

12 Claims, 7 Drawing Sheets

CONE CRUSHER

BACKGROUND OF THE INVENTION

1. Field of the Invention

The present invention relates to a cone crusher used to crush rocks, ores and the like.

2. Description of the Related Art

In a cone crusher in which a truncated-cone shaped mantle is eccentrically rotated within a conical cylindrical concave fit in an upper body of a machine body to press and crush raw materials such as rocks, ores and the like supplied from the top between the concave and the mantle, a lower clearance at which the rotating mantle moves closest to the concave is called an outlet clearance (on the closed side), the outlet clearance determining a crashing size. A structure for changing and adjusting the outlet clearance are roughly grouped into two types as follows.

In one type, the mantle side is moved by a hydraulic mechanism to change the outlet clearance. In this type of cone crusher, as shown in FIG. 3A, a head center (32*a*) of a main shaft (32) having a mantle (33) mounted thereon is vertically moved by a piston rod (35*a*) of a hydraulic cylinder (35) the hydraulic cylinder 35 is provided within the main shaft (32) to change an outlet clearance α between the mantle (33) to change (34) fitted within an upper body (31*a*) of a machine body (31). Further, in the cone crusher of this type, as shown in FIG. 3B, a magnetic strain type stroke detection device (36) is disposed under the hydraulic cylinder (35), and a moving amount of the piston rod (35*a*), which is a height position of the mantle (33), is detected by the stroke detection device (36) whereby the operation of the hydraulic cylinder (35) is controlled to remotely change and adjust the outlet clearance α.

In the other type, a concave side is moved by a screw mechanism to change the outlet clearance. In this type of cone crusher, as shown in FIG. 4A, a concave support (45) having a concave (44) fit internally thereof is rotatably threadedly fit in a cylindrical upper body (41*a*) fixedly arranged at the upper part of a machine body (41), and the concave support (45) is rotated and vertically moved to change the outlet clearance α between the concave (44) and a mantle (43) mounted on a main shaft (42). As a method for rotating the concave support (45), a method has been heretofore often employed in which a plurality of pressure receiving rods (45*a*) provided equidistantly on an upper outer circumference of the concave support (45) are pressed and rotated by a plurality of hydraulic cylinders (46) rotatably arranged at the upper part of the upper body (41*a*), as shown in FIG. 4B. Recently, however, a method has been proposed and put to a practical use in which a gear (47) is mounted on an upper outer circumference of the concave support (45), a driving device (48) having a wide pinion (48*a*) meshed with the gear (47) is disposed at the upper part of the upper body (42*a*), and the concave support (45) is rotated by the driving device (48), as shown in FIG. 4C.

Incidentally, in these types of cone crushers, as the crushing repeatedly proceeds, abrasion of the concave and mantle increases to enlarge and change the outlet clearance for determining the crushing size. Accordingly, the crushing size changes and the yield of good product lowers unless the outlet clearance is adjusted not only at the time of assembly and at the time of initial operation, but also at the time after operation for a certain period of time.

On the other hand, recently, with a severer demand of quality on the user's side, the importance of adjustment of the crushing size, which is the outlet clearance, has risen. Further, for the purpose of continuing a stable operation, it is also necessary to detect on abrasion amount of the concave and mantle to replace them at an adequate time. It is important to know a changing value of the outlet clearance in order to change and adjust it at an adequate time.

However, in the conventional cone crusher employing the latter type as described above, there is no function to detect the height position of the concave, that is, the outlet clearance. Thus the conventional cone crusher has a problem in that one cannot but employ relatively cumbersome and inaccurate methods such as a method in which for changing and adjusting the outlet clearance, the size of crushed articles is periodically measured, and the adjusting time and amount are set from the change of the crushing size, and a method in which in changing and adjusting it, a lead ball is inserted into a part on the closed side between the concave and the mantle to crush it whereby the outlet clearance after adjustment is assured.

From a viewpoint of the above, the present inventors have filed, prior to the instant application, a Japanese patent application for a cone crusher having an improved construction in which a moving amount of a concave which is vertically moved by a screw mechanism whereby an outlet clearance between the concave and a mantle and abrasion amount thereof can be measured, and the outlet clearance can be remotely changed and adjusted on the basis of the measured value (Japanese Patent Application LaidOpen No. 154630/1994).

In the cone crusher according to the aforementioned prior application, as shown in FIG. 2 which is an explanatory view of a schematic construction thereof, a concave support (25) having a concave (24) fit internally thereof is rotatably threadedly fit within an upper body (21*a*) of a machine body (21), an annular large gear (25*b*) is mounted on an outer periphery of an upper cover (25*a*) provided on the concave support (25), and a wide pinion (26*a*) of a driving device (26) disposed on the outer periphery of the upper body (21*a*) is meshed with the large gear (25*b*) whereby the concave support (25) is rotated by the driving device (26) so that the concave support (25) is vertically moved to change and adjust an outlet clearance α between the concave (24) and a mantle (23) mounted on a main shaft (22).

The driving device (26) is constructed such that the pinion (26*a*) is mounted on an outlet shaft of a driving motor (26*b*) having a torque limiter coupling (26*c*) interposed therein, the driving motor (26*b*) being connected to an external control device (29). A rotation detection device (27) for detecting a rotation of the pinion (26*b*) is disposed at the upper part of the driving device (26), the rotation detection device (27) being connected to an external operation display device (28), which is in turn connected to the control device (29) of the driving device (26).

On the other hand, the operation display device (28) has a function to process an electric signal output from the rotation detection device (27) in accordance with a conversion program to index a rotational frequency of the concave support (25), to operate a vertical moving amount from a reference height position, and to operate an outlet clearance α from an angle of inclination between the mantle (23) and the concave (24) known previously and the above-described moving amount, these values being stored erasably and displayed.

In the above-described prior cone crusher, in the remote control of the driving device, the concave support is moved down until the mantle and the concave come into contact on the closed side, after which they are moved upward equally to the value of the set outlet clearance on the basis of processed data by the operation display device.

However, in the above-described prior cone crusher, the operating property of the actual operation thereof was studied in more detail, as a result, we found that the following problem remained as a problem to be solved.

That is, in this cone crusher, in the initial setting of and in the resetting of the outlet clearance, the concave is moved down until the mantle and concave come into contact, and a stop height position thereof is input as a zero position of the outlet clearance at the initial setting and resetting into the operation display device to grasp the setting of the outlet clearance and the abrasion amount. In this case, the contact between the mantle and the concave is detected in such a manner that the rotation of the pinion of the driving device stops due to the contact therebetween and an output value from the rotation detection device is zero. At this time, the torque limiter coupling of the driving device slips so that the pinion ceases to rotate, which is detected by the stop of the driving motor.

On the other hand, when the mantle and concave come to contact by the downward movement of the concave support, a clearance between the concave support and the threads disappears and they become fastened to each other. Therefore, when the driving motor is stopped when the torque limiter coupling slips, the torque of the set value of the torque limiter coupling is applied as a thread tightening force, and in addition, an inertia force at the time when the concave support being rotated stops is also applied as a tightening force. Therefore, the concave support and the threads of the upper body are fastened with an excessively large force.

Therefore, it is necessary to reverse the driving motor to move the concave support upward to disengage the tightening between the concave support and the upper body. However, since the tightening force therebetween already exceeds the set torque, there gives rise to an inconvenience that the outlet clearance cannot be set unless the tightening force for rotating the concave support is released.

Accordingly, in order that the setting of the outlet clearance following the setting of the zero position of the outlet clearance due to the contact between the mantle and concave is carried out to improve the operating property, it is necessary to detect the contact between the mantle and the concave to stop the operation of the driving device before the operation of the torque limiter coupling, that is, before a surplus tightening force in excess of the set torque occurs between the concave support and the upper body.

SUMMARY OF THE INVENTION

It is therefore an object of this invention to provide for a cone crusher which can maintain an outlet clearance efficiently and within a proper range.

It is another object of this invention to provide for a cone crusher which can replace a concave and a mantle at an adequate time and can stabilize a crushing quality and an operation.

According to a preferred embodiment of the present invention, there is provided an arrangement comprising: a conical cylindrical rotating mantle; a concave disposed opposite to said mantle; a concave support mounted on which said concave is mounted, said concave support being rotated whereby said concave support can be vertically moved to adjust an outlet clearance between said mantle and said concave; contact detection means for detecting a contact between said mantle and said concave, said outlet clearance capable of being adjusted on the basis of information at the time of the contact detected by said contact detection means.

In detecting the contact, a variation of a current or an oil pressure value input into drive means for rotating said concave support may be detected, or a variation of a backpressure of a static pressure type thrust bearing mounted on a shaft of a mantle may be detected.

DESCRIPTION OF THE PREFERRED EMBODIMENTS

Figure 1A:
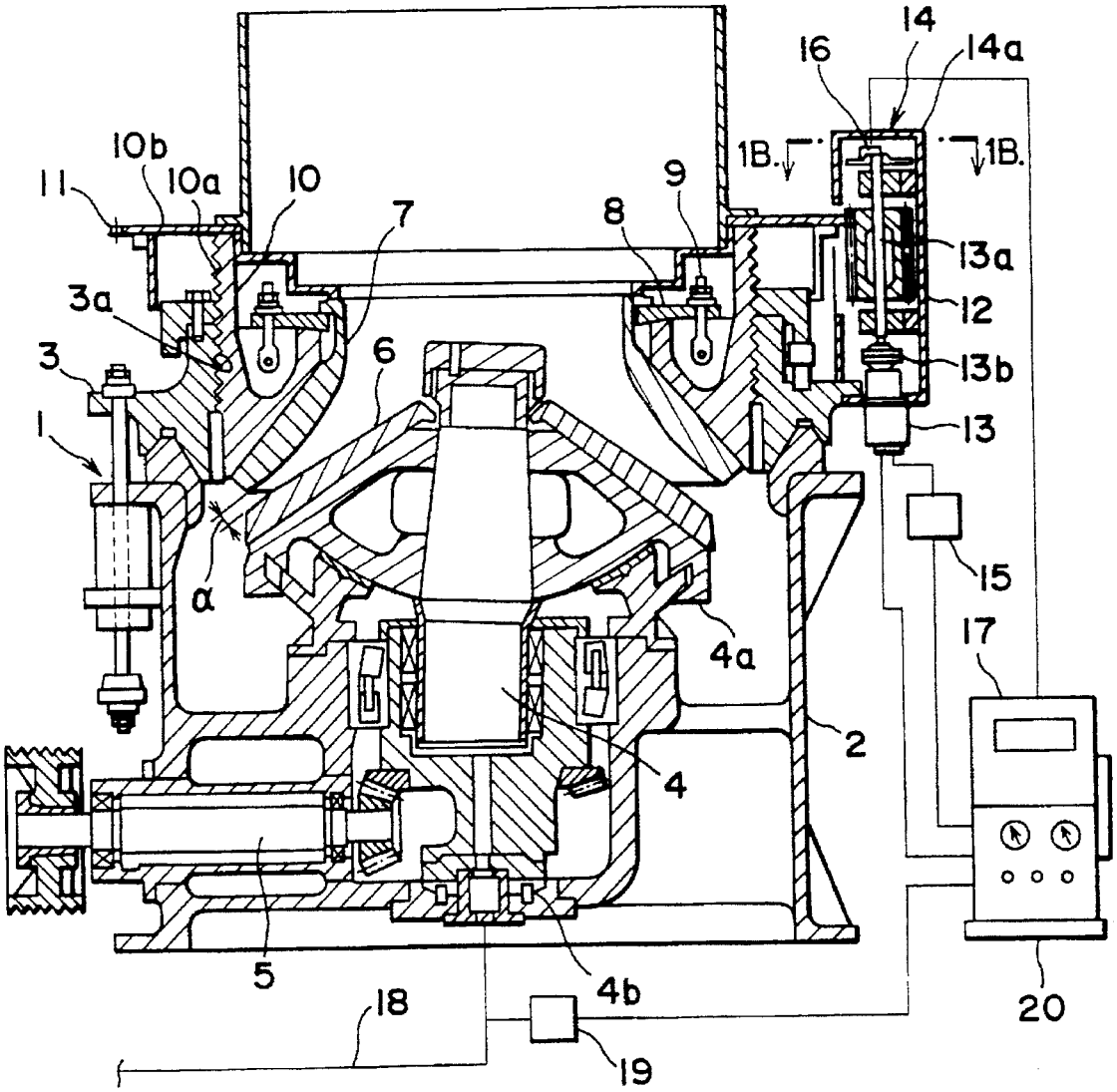
FIG. 1A is a front sectional view showing a schematic configuration of a cone crusher according to an embodiment of the present invention.

In a cone crusher according to the present embodiment of the present invention, as shown in FIG. 1A, a main shaft (4) an upper part of which eccentrically turns and a pinion shaft (5) driven by a main driving device (not shown) to rotate the main shaft (4) are disposed within a lower body (2) of a machine body (1), and a conical cylindrical mantle (6) fit on a head center (4*a*) of the main shaft (4) is eccentrically rotated inside a conical cylindrical concave (7) fit in an upper body (3) of the machine body (1) to press and crush raw materials such as rocks, ores and the like supplied from the top, between the concave (7) and the mantle (6).

A static pressure type thrust bearing (4*b*) connected to a lubricating oil supply device (not shown) is disposed at a lower end of the main shaft (4), and an axial force loaded on the main shaft (4) through the static pressure type thrust bearing (4*b*) is supported by the lower body (2) of the machine body (1).

On the other hand, the upper body (3) is formed to be cylindrical shape having sawtooth threads (3*a*) provided in an inner periphery thereof, and the upper body (3) is rotatably threadedly fit to a concave support (10) having sawtooth threads (10*a*) provided in an outer periphery thereof. A plurality of support levers (8) having a distal end fastened by a fastening bolt (9) are provided at the upper part of an inner side of the concave support (10). The upper end of the concave (7) is supported by these support levers (8) to fit and hold the concave (7) inside the concave support (10).

Further, at the upper end of the concave support (10) is provided an upper cover (10*b*) in which an outer peripheral end thereof is extended so as to cover a threaded portion of the concave support (10) and an inner peripheral end is brought into contact with an upper open end of the concave (7) through a seal member to cover the threaded portion and the arranging portion of the support levers (8) and being formed with a charging port for guiding the raw materials supplied from the top into the concave (7). An annular large gear (11) is mounted on the outer peripheral portion of the upper cover (10*b*), and a wide pinion (12) of a driving device (14) disposed on the outer peripheral side of the upper body (3) is meshed with the large gear (11).

The driving device (14) has a driving motor (13) having a torque limiter coupling (13*b*) interposed in an outlet shaft (13*a*) and the pinion (12) mounted on the output shaft (13*a*) of the driving motor (13), said driving motor (13) and said pinion (12) being integrally incorporated into a box-like support mount (14*a*), and is mounted on the outer peripheral portion of the upper body (3) through the support mount (14*a*).

Further, the driving motor (13) is connected to an external control device (20) through an input circuit and also connected to the control device (20) through a feedback circuit provided with an input detection device (15) for detecting a variation of a current value input from the control device (20) to output it as an electric signal. The driving motor (13) is normalized and reversed by the control device (20) to rotate and vertically move the concave support (10) through the pinion (12) and the large gear (11) whereas a variation from a steady value of a current value required by the driving and rotation thereof is detected by an input detection device (15) to feedback it to the control device (20).

Figure 1B:
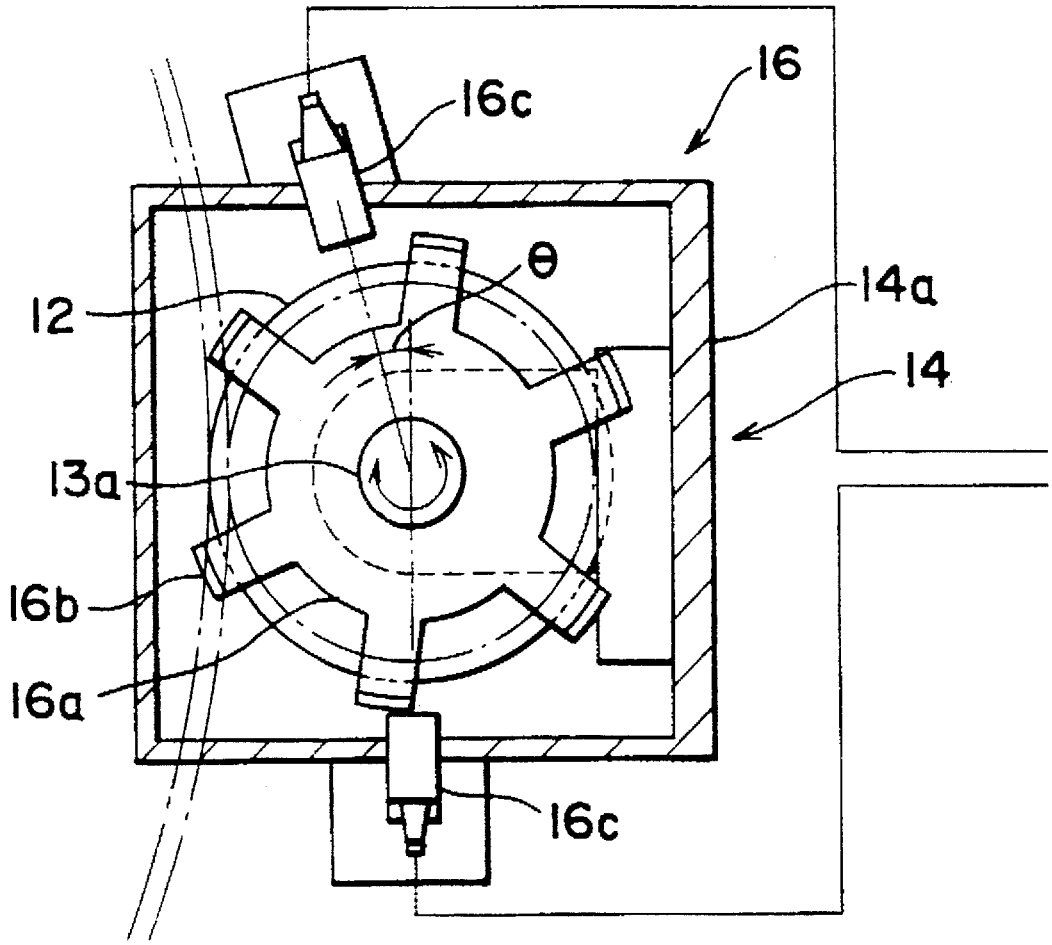
FIG. 1B is a sectional view taken on line 1B—1B of FIG. 1A.
Figure 2:
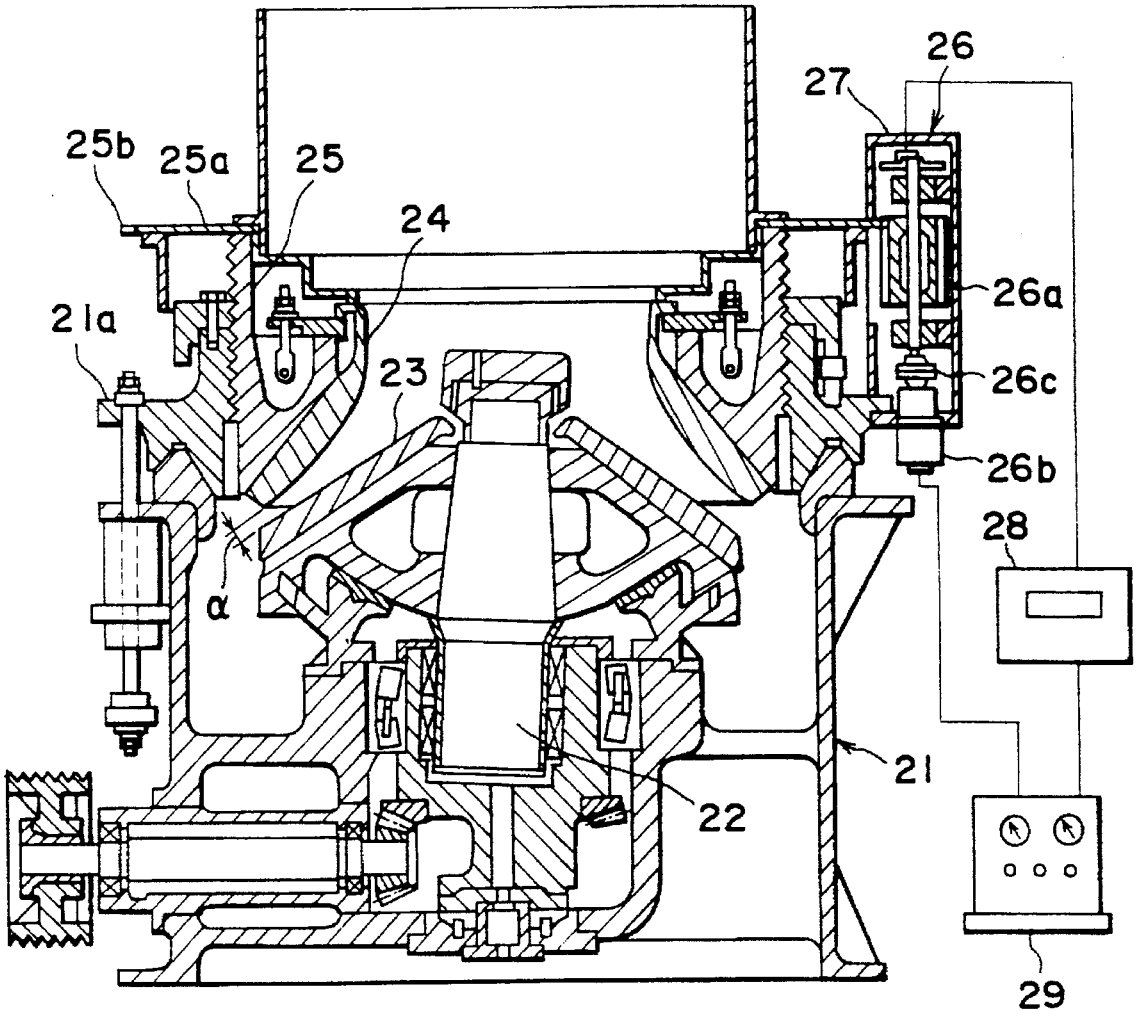
FIG. 2 PRIOR ART
FIG. 2 shows a cone crusher previously filed.
Figure 3A:
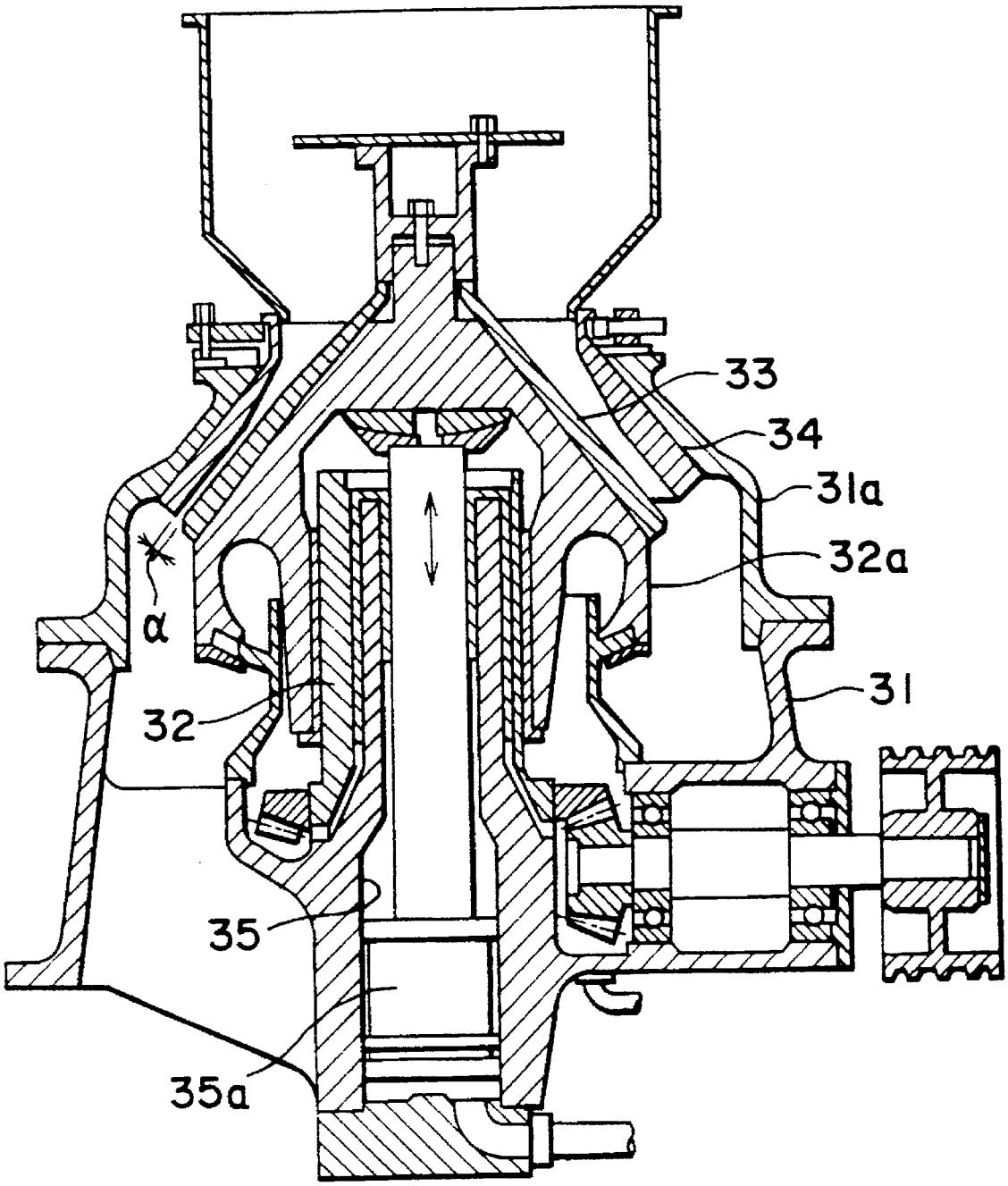
FIG. 3A PRIOR ART
FIGS. 3A, 3B, and FIGS. 4A, 4B, and 4C show conventional cone crushers.
Figure 3B:
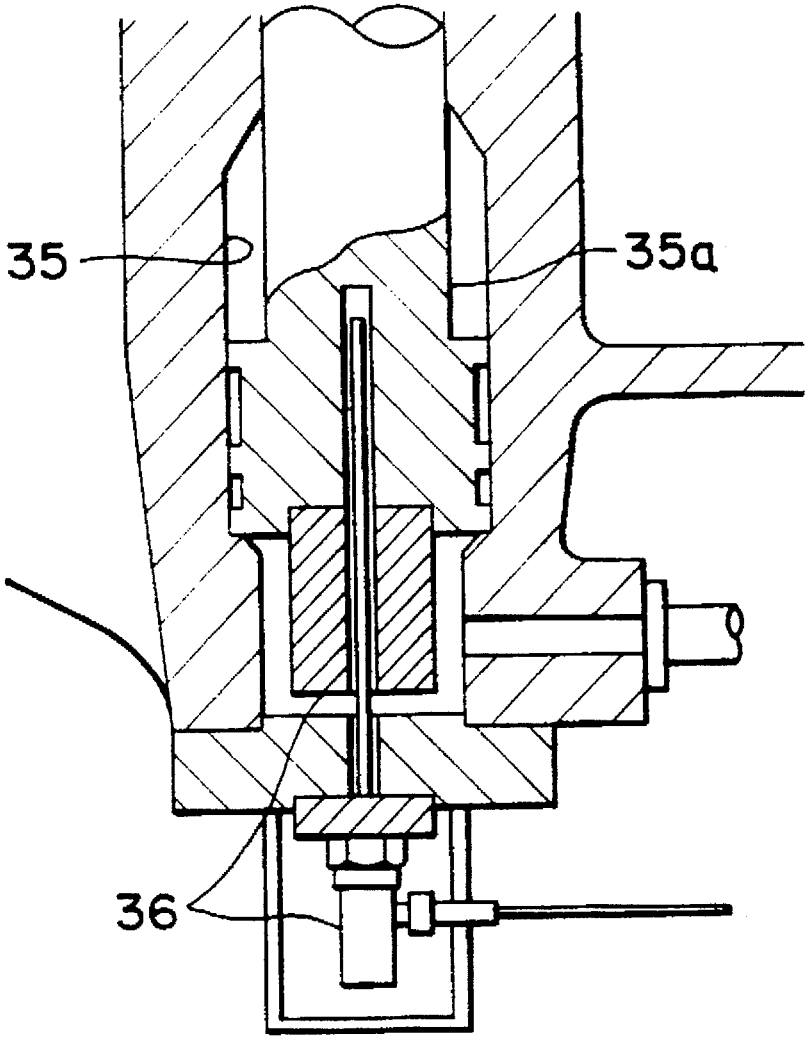
FIG. 3B PRIOR ART
Figure 4A:
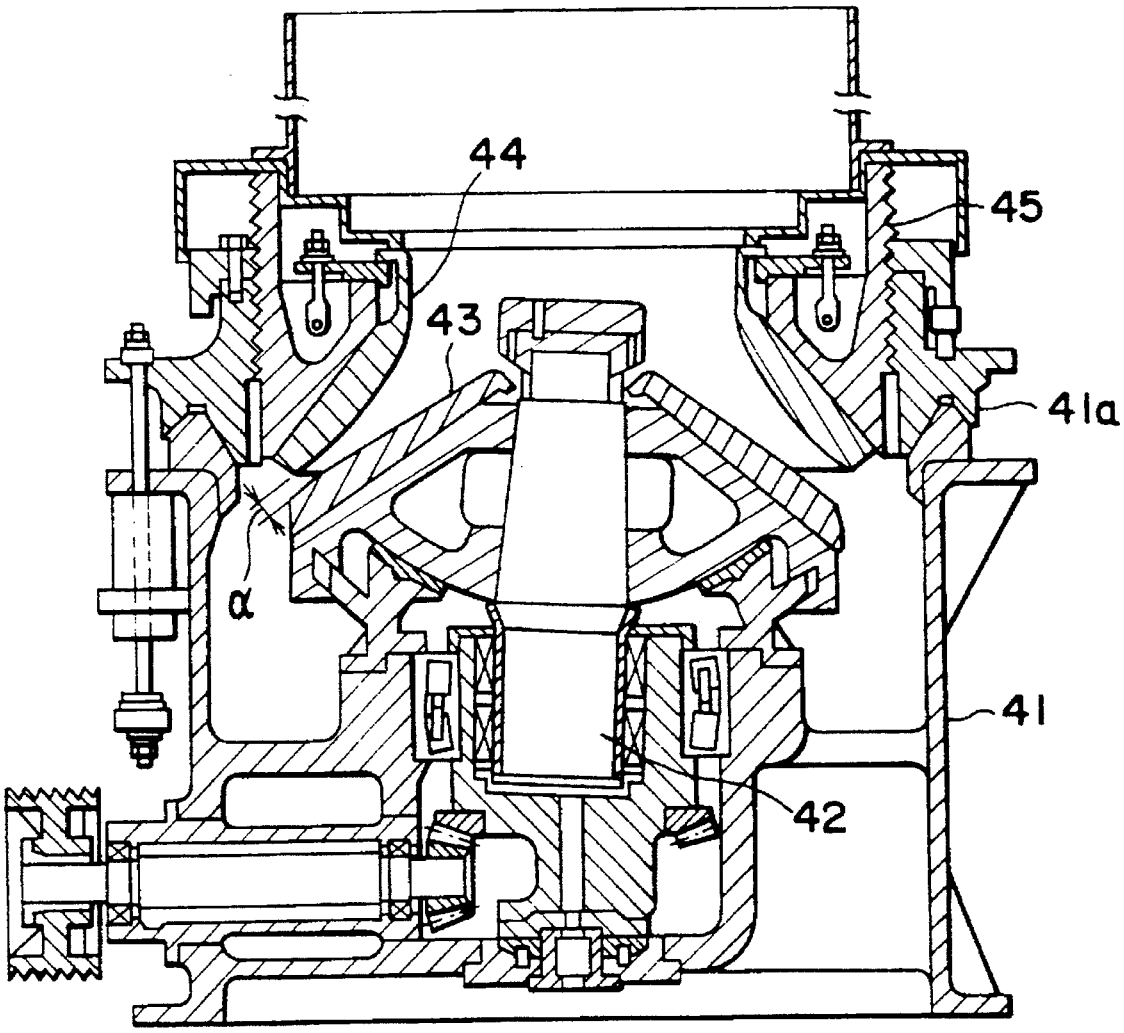
FIG. 4A PRIOR ART
Figure 4B:
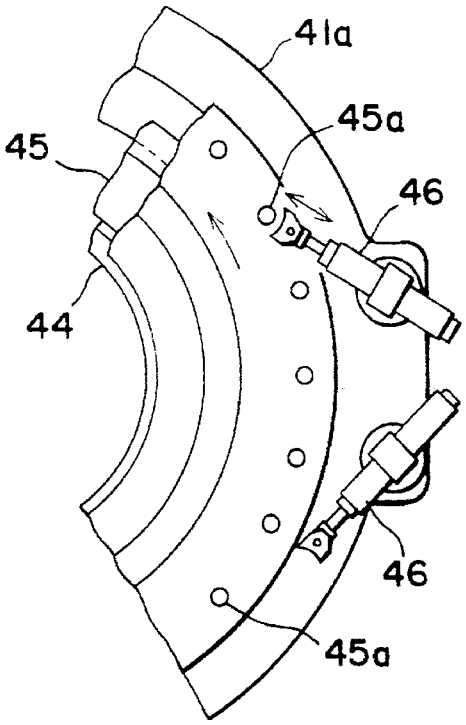
FIG. 4B PRIOR ART
Figure 4C:
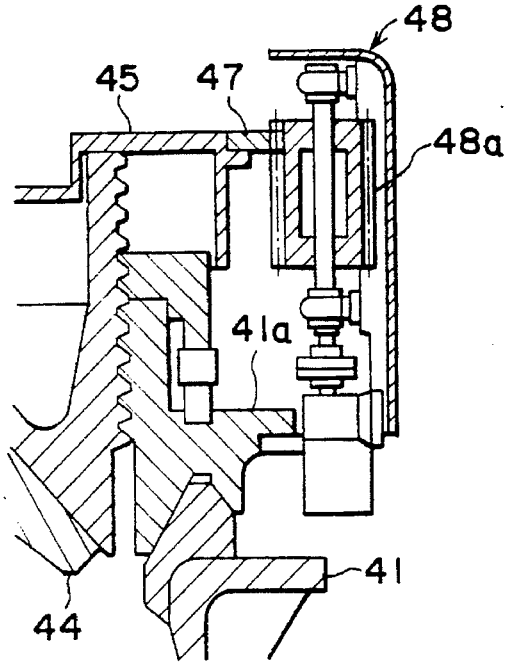
FIG. 4C PRIOR ART

As shown in FIG. 1B, at the upper part of the support mount (14*a*) of the driving device (14) are provided a rotary disk (16*a*) mounted on the upper end of the output shaft (13*a*) of the driving motor (13) and having a plurality of strikers (16*b*) in the outer periphery thereof and a pair of proximity switches (16*c*) which extend through both side walls of the support mount (14*a*), whose detecting portions are finely spaced apart from the outer peripheral edge of the strikers (16*b*) and are opposed with a deviation angle with respect to a rotational center of the rotary disk (16*a*), further being provided with a rotation detection device (16) for detecting the number of revolutions of the output shaft (13*a*) of the driving motor (13), that is, the number of revolutions of the pinion (12). The deviation angle θ of the pair of proximity switches (16*c*) of the rotation detection device (16) is set to an angle calculated in accordance with the formula, 360°/number of rovolutions×4. The rotation detection device (16) is connected to an operation display device (17) to output a detected value as an electric signal to the operation display device (17).

On the other hand, the operation display device (17) comprises a sequencer having a program for calculating and converting an electric signal output from the rotation detection device (16) into a rotational direction (±) and the number of revolutions (n) and a program for operating and storing in binary number system a vertical moving amount S of the concave support (10) under the relationship of S=n.Z2/Z1.p from a pitch p of the sawtooth threads (10*a*) of the concave support (10), the number of teeth Z1 of the large gear (11), the number of teeth Z2 of the pinion (12), and the number of revolutions n of the pinion (12) obtained by the electric signal of the rotation detection device (16); a set value input and calculation section having a program for receiving a set outlet clearance value $\alpha_o$ and a reference height position h of the concave support (10) and for comparing and adjusting data calculated and stored by the sequencer, and operating the value of the outlet clearance α from an angle of inclination θ' between the mantle and the concave (7) and the moving amount S previously known to erasably store it; and four display sections for converting binary data operated, stored and directly input by the sequencer and the set value input and operation section into a decimal numeration system to display it. The operation display device (17) is disposed on the control device (20) and connected to the control device (20).

Furthermore, a backpressure detection device (19) for detecting a pressure variation of lubricating oil supplied to the static pressure type thrust bearing (4*b*) to output it as an electric signal is disposed on an oil pipe (18) for connecting the static pressure type thrust bearing (4*b*) disposed at the lower part of the main shaft (4) with the lubricating oil supply device (not shown), said backpressure detection device (19) being connected to the control device (20), and the detected pressure variation of the static pressure type thrust bearing (4*b*), which is the variation of the backpressure, is output to the control device (20) of the driving device (14).

In the cone crusher according to the present embodiment as described above, the driving motor (13) of the driving device (14) is rotated in a normal direction in which the concave support is moved down, and so that the concave (7) fit in the concave support (10) and the lower mantle (6) are brought into contact.

At this time, the rotational resistance with respect to the concave support (10) rises to derive a rise of current value of the driving motor (13), and when the mantle (6) is pressed down, the backpressure of the static pressure type thrust bearing (4*b*) at the lower end of the main shaft (4) rises, which is detected by the backpressure detection device (19), and they are transmitted to the control device (20).

A stop current value A, which is set to be higher than a steady current value of the driving motor (13) but lower than a current at a set torque of the torque limiter coupling (13*b*) and a stop backpressure value Ps which is set form a designed (4) obtained when the driving motor (13) is driven by the stop current value $A_s$ to bring the concave (7) into contact with the mantle (6) are previously stored in the control device (20). When the detected values by the input detection device (15) and the backpressure detection device (19) reaches the set stop values $A_s$ and $P_s$, the output to the driving device (14) from the control device (20) immediately stops whereby the driving motor (13) is stopped before the torque limiter coupling (13*b*) slips.

Then, a height position of the concave support (10) at the time of stop is input and stored in the operation display device (17) as a zero position $h_o$ of an initial outlet clearance, and a zero point is displayed on the first, second and third display sections. A difference $\Delta t_o$ of the detection times of the set stop values between the input detection device (15) and the backpressure detection device (19) is stored as a reference detection time difference $\Delta t_3$ in the control device (20) or is separately recorded.

On the other hand, the set outlet clearance value $\alpha_o$ and the inclination angle θ' between the mantle (6) and the concave (7) are previously input and stored in the operation display device (17). Further, the vertical moving amount S from the reference height position h of the concave support (10) obtained from the number of revolutions of the pinion (12) is displayed for reference on the first display section; the value of the outlet clearance α obtained from the moving amount S and the inclination angle θ' is displayed on the second and third display sections; and the set outlet clearance value $\alpha_o$ is displayed for reference on the fourth display section.

Subsequently, the driving motor (13) is reversed from that condition to move upward the concave support (10) and stop the latter when the value of the outlet clearance α on the third display section of the operation display device (17) coincides with the set outlet clearance value $\alpha_o$ on the fourth display portion, and the initial outlet clearance α is set.

In the present embodiment, it is designed so that the operation display device (17) is provided with a program which, when the value of the outlet clearance α after a zero point is set coincides with the set outlet clearance value $\alpha_o$ inputted previously, outputs a stop signal of the driving motor (13) to the control device (20), and the reversal of the driving motor is automatically stopped to set the initial outlet clearance α.

In the cone crusher according to the present embodiment, at a suitable time after operation has been continued for a certain period of time, or at a time of changing a crushing size, the driving motor (13) is operated, similarly to the initial set time, to move down the concave support (10) until the concave (7) and the mantle (6) come into contact at the closed side part and thereafter move upward equally to the set outlet clearance value $\alpha_o$ to reset the outlet clearance α. At this time, only the value of the outlet clearance α displayed on the third display section of the operation display device (17) is changed to a zero point display, and when the value of the outlet clearance α on the third display section coincides with the set outlet clearance value $\alpha_o$ on the fourth display section, the driving motor (13) is stopped to reset the outlet clearance α.

In resetting, when the detected values of the input detection device (15) and the backpressure detection device (19) are variations reaching the set stop values $A_s$ and $P_s$, the driving motor (13) stops. At this time, the difference $\Delta t_R$ of the detecting time of the set stop value therebetween is compared with the standard detection time difference $\Delta t_s$ stored or recorded at the initial setting operation, when one detection time is greatly delayed than the range of the standard detection time difference $\Delta t_s$ and the driving motor (13) is stopped merely by one detection value, the following resetting of the outlet clearance stops. An alarm is raised to indicate an abnormal condition of the lubricating system for the static pressure thrust bearing (4*b*) of the main shaft (4) or a defective lubrication between the concave support (10) and the upper body (3), and after inspection and maintenance therefor have been done, the outlet clearance α is reset again in the above-described procedure.

In the cone crusher according to the present embodiment in which the initial setting and resetting of the outlet clearance α take place in the manner as described above, the contact between the concave (7) and the mantle (6) for setting the outlet clearance zero position is positively detected by the two detection means, the input detection device (15) and the backpressure detection device (19) and controlled by the control device 20 as an adjustment stop means to stop the driving motor (13) before a surplus tightening force between the concave support (10) and the upper body (3), that is, before the torque limiter (13*b*) of the driving device (14) slips. Therefore, the upward movement of the concave support (10) in the succeeding setting of the outlet clearance α can be made easy and smooth.

Further, in resetting, the detection time difference $\Delta t_R$ of the set detected value between the input detection device (15) and the backpressure detection device (19) is compared with the standard detection time difference $\Delta t_s$ set at the initial set time whereby an abnormal condition due to defective oil supply or lubrication between the static pressure type thrust bearing (4*b*) and the concave support (10) in the main operating section (4) and the upper body (3) can be detected early to make the maintenance of the cone crusher sure.

Further, in the cone crusher according to the present embodiment, in resetting the outlet clearance α, a variation of the value from a zero point initially set, that is, a variation of a height position from a zero position $h_o$ of the initial outlet clearance is continuously displayed without changing the value of the moving amount S on the first display section and the value of the outlet clearance α on the second display section of the operation display device (17) to thereby grasp a relative abrasion amount between the mantle (6) and the concave (7) at the reset time and the variation of the outlet clearance α caused by the abrasion can be automatically corrected.

That is, at the time of contact between the mantle (6) and the concave (7), the value of the outlet clearance α on the third display section is changed to a zero point display and is riser equally to the set outlet clearance value $\alpha_o$ from the zero point to reset the outlet clearance α whereby a varied portion caused by the abrasion of the mantle (6) and the concave (7) can be automatically corrected, and the relative abrasion amount between the mantle (6) and the concave (7) caused by crushing can be grasped from the difference of the outlet clearances α displayed on the second display section and the third display section. Furthermore, this abrasion data is stored in the operation display device (17) to correspond to the post-crushing conditions to make analysis of abrasion amount and speed useful.

As described above, in the cone crusher according to the present embodiment, the outlet clearance between and the abrasion of the concave and the mantle can be measured simply and with accuracy by one stroke of the upward and downward movement of the concave support by a remote control, the outlet clearance on the basis of the measured value can be automatically changed and adjusted under the smooth operating property, the abnormal condition of lubrication of the main operating section can be detected, whereby the outlet clearance can be maintained in a proper range, and the replacement of the concave and the mantle and inspection and maintenance of the operating section can be carried out at a proper time to stabilize the crushing quality and operation.

In the cone crusher according to the present embodiment, the driving device (14) for rotating the concave support (10) to move up and down has the electric driving motor (13) and is provided with the input detection device (15) for detecting the variation of electric current of the driving motor (13) of the driving device (14) and the backpressure detection device for detecting the variation of backpressure of the static pressure thrust bearing (4*b*) of the main shaft (4) in order to detect the contact between the concave (7) and the mantle (6) caused by downward movement of the concave support (10). However, the present invention is not limited to the above-described type.

For example, in the cone crusher according to the present embodiment, even if the input detection device (15) is omitted, the contact between the concave (7) and the mantle (6) can be detected by the backpressure detection device (10) to stop the driving motor (13) before the torque limiter coupling (13*b*) slips. Further, in the case of a cone crusher in the type which employs a thrust bearing of the main shaft (4) of the type other than the static pressure type, an input detection device (15) of the construction and arrangement similar to that of the abovedescribed embodiment can be arranged to detect the contact between the concave (7) and the mantle (6) to stop the driving motor (13) before the torque limiter coupling (13*b*) slips.

Further, a hydraulic driving system may be used for the driving motor for the driving device. In this case, needless to say, the input detection device may detect a variation of an oil pressure value input into the driving motor to output it as an electric signal to the control device.

Further, in the cone crusher according to the above-described embodiment, the number of revolutions of the pinion (12) is detected by the rotation detection device (16)

provided with the rotary disk (16*a*) having a plurality of strikers (16*b*) in the outer periphery thereof and the pair of proximity switches (16*c*) to thereby obtain the moving amount S of the concave support (10) to set the outlet clearance α. This is because of the fact that the pair of proximity switches (16*c*) are opposed with a deviation angle θ with respect to the rotational center of the rotary disk (16*a*) whereby normal and reverse rotations can be easily detected, and there is no contact and sliding portions and the number of revolutions of the pinion (12) can be detected accurately by a simple construction with less maintenance and management. The present invention is not limited to the above described construction but if it is one which can detect the number of revolutions of the concave support (10) or the pinion (12) to output it as an electric signal to the operation display device (17), detection devices of other types such as a pulse generator used conventionally to detect the rotation of the shaft may be employed.

Alternatively, the pair of proximity switches (16*c*0 are opposedly arranged by moving in parallel in the opposite to or the same directions as each other with respect to the rotational center of the rotary disk (18*a*), whereby a deviation is provided with respect to the rotational center of the rotary disk (16*a*), whereby the normal and reverse rotational directions of the rotary disk (16*a*) can be detected.

We claim:

1. A cone crusher comprising:

a rotating conical cylindrical mantle;

a static pressure type thrust bearing arranged under a shaft for rotating said mantle;

a concave disposed opposite to said mantle;

a concave support on which said concave is mounted, said concave support being rotated by driving means to move up and down so as to adjust an outlet clearance between said mantle and said concave;

first contact detection means for detecting a variation of a current or oil pressure value inputted into said driving means to detect a contact between said mantle and said concave; and second contact detection means for detecting a variation of backpressure of said static pressure thrust bearing to detect the contact between said mantle and said concave, said outlet clearance capable of being adjusted on the basis of information at the time of the contact detected by said first contact detection means and said second contact detection means.

2. A cone crusher according to claim 1, further comprising adjustment stop means for stopping an adjusting of the outlet clearance before a surplus tightening between said mantle and said concave in accordance with information at the time of the contact detected by said first contact detection means of said second contact detection means.

3. A cone crusher according to claim 2, further comprising zero position display means for displaying a position of the concave as an initial clearance zero position at the time when the adjustment of the outlet clearance is stopped.

4. A cone crusher according to claim 2, further comprising outlet clearance display means for displaying the outlet clearance set after the adjustment of the outlet clearance has been stopped.

5. A cone crusher according to claim 1, further comprising abnormality detection means for judging that when a difference between contact times detected by the first contact detection means and the second contact detection means is not in a reference value, an abnormal condition occurs.

6. A cone crusher comprising:

a rotating conical cylindrical mantle;

bearing means operationally associated with a shaft for permitting a rotation of said mantle;

a concave disposed opposite to said mantle;

a concave support on which said concave is mounted, said concave support being rotated by driving means to move up and down so as to adjust an outlet clearance between said mantle and said concave;

first contact detection means for detecting a variation of a current or oil pressure value inputted into said driving means for rotating said concave support to detect a contact between said mantle and said concave, said outlet clearance capable of being adjusted on the basis of information at the time of the contact detected by said first contact detection means; and second contact detection means for detecting a variation of backpressure of said bearing means to detect the contact between said mantle and said concave, said outlet clearance capable of being adjusted on the basis of information at the time of the contact detected by said second contact detecting means.

7. A cone crusher according to claim 6, further comprising adjustment stop means for stopping an adjustment of the outlet clearance before a surplus tightening between said mantle and said concave in accordance with information at the time of the contact detected by said first contact detection means or said second contact detection means.

8. A cone crusher according to claim 7, further comprising zero position display means for displaying a position of the concave as an initial clearance zero position at the time when the adjustment of the outlet clearance is stopped.

9. A cone crusher according to claim 7, further comprising outlet clearance display means for displaying the outlet clearance set after the adjustment of the outlet clearance has been stopped.

10. A cone crusher comprising:

a rotating conical cylindrical mantle;

a concave disposed opposite to said mantle;

a concave support on which said concave is mounted, said concave support being rotated to move up and down so as to adjust an outlet clearance between said mantle and said concave;

contact detection means for detecting a contact between said mantle and said concave, said outlet clearance capable of being adjusted in accordance with information at the time of contact detected by said contact detection means; and adjustment stop means for stopping an adjustment of the outlet clearance before a surplus tightening between said mantle and said concave occurs in accordance with information at the time of the contact detected by said contact detection means.

11. A cone crusher according to claim 10, further comprising zero position display means for displaying a position of the concave as an initial clearance zero position at the time when the adjustment of the outlet clearance is stopped.

12. A cone crusher according to claim 10, further comprising outlet clearance display means for displaying the outlet clearance set after the adjustment of the outlet clearance has been stopped.

* * * * *